US005893372A

United States Patent [19]

Hampl, Jr.

[11] Patent Number: 5,893,372

[45] Date of Patent: Apr. 13, 1999

[54] HIGH OPACITY WRAPPING PAPER

[75] Inventor: Vladimir Hampl, Jr., Roswell, Ga.

[73] Assignee: Schweitzer Maudit International, Inc., Alpharetta, Ga.

[ * ] Notice: This patent issued on a continued prosecution application filed under 37 CFR 1.53(d), and is subject to the twenty year patent term provisions of 35 U.S.C. 154(a)(2).

[21] Appl. No.: 08/833,579

[22] Filed: Apr. 7, 1997

[51] Int. Cl.[6] ..... A24C 1/00

[52] U.S. Cl. ..... 131/365; 131/280

[58] Field of Search ..... 131/365, 280, 131/360, 362; 428/364

[56] References Cited

U.S. PATENT DOCUMENTS

| | | | |
|---|---|---|---|
| 3,744,496 | 7/1973 | McCarty et al. . | |
| 4,225,636 | 9/1980 | Cline et al. . | |
| 4,318,959 | 3/1982 | Evans et al. | 428/364 |
| 4,411,279 | 10/1983 | Martin et al. . | |
| 4,453,553 | 6/1984 | Cohn . | |
| 4,480,644 | 11/1984 | Luke . | |
| 4,503,118 | 3/1985 | Murakami et al. . | |
| 4,505,282 | 3/1985 | Cogbill et al. . | |
| 4,548,677 | 10/1985 | Schneider et al. . | |
| 4,725,318 | 2/1988 | Minayoshi et al. . | |
| 4,732,748 | 3/1988 | Stewart et al. . | |
| 4,805,644 | 2/1989 | Hampl, Jr. et al. . | |
| 4,986,285 | 1/1991 | Radzio et al. | 131/280 |
| 4,998,543 | 3/1991 | Goodman et al. . | |
| 5,060,675 | 10/1991 | Milford et al. . | |
| 5,074,321 | 12/1991 | Gentry et al. . | |
| 5,103,844 | 4/1992 | Hayden et al. . | |
| 5,105,835 | 4/1992 | Drewett et al. . | |
| 5,107,864 | 4/1992 | Owens, Jr. . | |
| 5,107,866 | 4/1992 | Aronoff et al. . | |
| 5,109,876 | 5/1992 | Hayden et al. . | |
| 5,143,098 | 9/1992 | Rogers et al. . | |
| 5,144,967 | 9/1992 | Cartwright et al. . | |
| 5,152,304 | 10/1992 | Bokelman et al. . | |
| 5,156,719 | 10/1992 | Passaretti . | |
| 5,161,551 | 11/1992 | Sanders et al. . | |
| 5,168,884 | 12/1992 | Baldwin et al. . | |
| 5,172,708 | 12/1992 | Drewett et al. . | |
| 5,215,734 | 6/1993 | Kunesh et al. . | |
| 5,227,025 | 7/1993 | Kunesh et al. . | |
| 5,228,464 | 7/1993 | Owens, Jr. . | |
| 5,253,660 | 10/1993 | Dixit et al. . | |
| 5,263,500 | 11/1993 | Baldwin et al. . | |
| 5,271,419 | 12/1993 | Arzonico et al. . | |
| 5,302,437 | 4/1994 | Idei et al. . | |
| 5,307,823 | 5/1994 | Jones et al. . | |
| 5,327,916 | 7/1994 | Jones et al. . | |
| 5,360,023 | 11/1994 | Blakley et al. . | |
| 5,385,158 | 1/1995 | Owens, Jr. . | |
| 5,404,890 | 4/1995 | Gentry et al. . | |
| 5,417,228 | 5/1995 | Baldwin et al. . | |
| 5,450,862 | 9/1995 | Baldwin et al. . | |
| 5,450,863 | 9/1995 | Collins et al. . | |
| B1 4,461,311 | 7/1991 | Mathews et al. . | |

FOREIGN PATENT DOCUMENTS

| | | |
|---|---|---|
| 135218 | 11/1949 | Australia . |
| 0533423 A1 | 3/1993 | European Pat. Off. . |
| 0066599 | 4/1984 | Japan . |
| 1194298 | 8/1985 | Japan . |
| 299699 | 10/1988 | Japan . |
| 405279993 | 10/1993 | Japan . |
| 405279994 | 10/1993 | Japan . |
| 249932 | 8/1969 | U.S.S.R. . |
| 249933 | 8/1969 | U.S.S.R. . |

OTHER PUBLICATIONS

Specialty Minerals, Inc., 1993, p. 151.0, Albafil ® M Slurry.
Specialty Minerals, Inc., 1993, p. 251.1, Albaglos ® Dry.
Specialty Minerals, Inc., 1994, Ultrapaque ™ Slurry.

*Primary Examiner*—Vincent Millin
*Assistant Examiner*—V Srivastava
*Attorney, Agent, or Firm*—Dority & Manning, P.A.

[57] ABSTRACT

The present invention is generally directed to high opacity cigarette wrapping papers. The wrapping paper made according to the present invention contains a mixture of a white pigment and a black pigment. The white pigment, which can be, for instance, calcium carbonate, has a median particle size of from about 0.1 microns to about 0.5 microns, and particularly from about 0.2 microns to about 0.4 microns. It has been discovered that this particular particle size range, which is equal to one-half the wavelength of visible light, greatly increases the opacity, brightness and whiteness of the paper. Small amounts of a black pigment, such as carbon, are then added to further increase the opacity without significantly decreasing the whiteness or brightness of the paper relative to conventional cigarette paper.

27 Claims, 3 Drawing Sheets

HIGH OPACITY WRAPPING PAPER

FIELD OF THE INVENTION

The present invention is generally directed to high opacity wrapping papers for use in smoking articles and to a method of producing the wrapping papers. More particularly, the present invention is directed to a wrapping paper that contains a mixture of white and black pigments that effectively both scatter and absorb light for increasing the opacity of the wrapping paper, while maintaining the brightness and the color of the paper within commercially acceptable ranges.

BACKGROUND OF THE INVENTION

Smoking articles such as cigarettes are conventionally made by wrapping a column of tobacco in a white wrapping paper. At one end, the smoking article usually includes a filter through which the article is smoked. Filters are attached to smoking articles using a tipping paper which is glued to the white wrapping paper. The wrapping papers and tipping papers used to construct smoking articles are typically made from flax or other cellulosic fibers and contain a filler, such as calcium carbonate.

Besides being used to hold the cigarette together, cigarette wrapping papers and tipping papers also contribute to and control many physical properties and characteristics of the cigarette. For instance, cigarette wrapping paper affects the rate at which the cigarette burns, the number of puffs per cigarette and the total tar delivery per puff Another property of the cigarette that is affected by the wrapper is the appearance and the characteristics of the ash that is formed as the cigarette burns. cigarette paper can even be used to limit the amount of smoke that emanates from the lit end of a cigarette when it is left burning and to reduce the tendency of a cigarette to ignite adjacent surfaces.

In addition to performing the above described functions, cigarette wrapping papers must also provide the cigarette with an overall aesthetic appearance. For instance, cigarette wrapping papers, which are mostly white, should have as bright a color as possible. Also, the paper should have a very high opacity. By having a high opacity, the wrapping paper masks the contents of the cigarette.

In the past, wrapping paper opacity was determined primarily as a function of the amount of filler incorporated into the papers. In general, opacity levels are increased as the amount of filler added to the paper is increased. Unfortunately, however, increasing filler levels to increase opacity can adversely effect other characteristics of the paper. For example, increasing filler levels can decrease the strength of the paper. Altering filler levels can also affect the permeability of the paper which may in turn affect the burn properties of the paper. As such, there is increasing pressure within the industry to keep filler levels in cigarette paper within preset ranges, severely restricting viable methods for increasing paper opacity.

Besides increasing filler levels, the opacity of cigarette paper can also be somewhat changed by changing the amount that the fiber furnish is refined and by altering the composition of the fiber furnish. Changing the fiber furnish or the amount that it is refined, however, may also adversely interfere with other physical characteristics of the paper. Further, varying refinement or selecting a different fiber furnish only provides small increases in opacity.

Due to the above limitations, commercial cigarette wrappers containing calcium carbonate as the filler generally only have an opacity of from about 74% to about 76% In the past, it has been extremely difficult to create a commercially acceptable paper wrapper having an opacity of 80% or above.

Thus, a need exists for a wrapping paper for smoking articles that has a high opacity, such as greater than 80%. Also, a need exists for a method of producing such wrappers. A need also exists for a method of increasing the opacity of cigarette wrapping papers without adversely interfering with other physical properties of the paper. A need further exists for a method for increasing the opacity of cigarette papers without having to increase filler levels.

SUMMARY OF THE INVENTION

The present invention recognizes and addresses the foregoing disadvantages, and others of prior art constructions and methods.

In general, the present invention is directed to high opacity wrapping papers for use in smoking articles. According to the present invention, the high opacity wrapping papers contain a mixture of a white pigment and a black pigment.

Paper opacity is a function of both the ability of the paper to scatter light and the ability of the paper to absorb light. According to the present invention, the white pigment, which can be calcium carbonate within a predetermined size range, is added to the paper in order to scatter light. The black pigment on the other hand, which can be, for instance, carbon, is added to the paper in order to absorb light. In general, the black pigment is added in amounts smaller than the amount of white pigment added.

In the past, carbon particles and calcium carbonate particles have both been present together in cigarette wrapping papers. For instance, U.S. Pat. No. 3,744,496 to McCarty, et al. is directed to a carbon filled wrapper for smoking articles. The carbon, however, is added, not to enhance the opacity of the paper, but to reduce components contained within the smoke of the cigarette. It is also disclosed to use the carbon for holding flavorants, which are released when heated. In particular, McCarty, et al. discloses adding to the paper from about 5% to about 90% by weight carbon.

When carbon was added to conventional cigarette papers as disclosed in McCarty, et al., however, the carbon significantly decreased the whiteness of the paper and the brightness of the paper to unacceptable levels. Consequently, most carbon filled papers used in the past for reducing smoke constituents or for containing flavorants were used solely as inner wrappers. In particular, a carbon filled paper was placed adjacent to the tobacco column and then covered with an outer wrapper for improving the aesthetic appearance of the cigarette. As stated in McCarty, et al., the outer wrapper was used to hide the grey carbon filled inner liner.

According to the present invention, however, black pigments are incorporated into cigarette wrappers for increasing the cigarette paper's opacity while maintaining the whiteness of the paper and the brightness of the paper at about the same levels as conventional wrapping papers. Accordingly, it is an object of the present invention to provide a high opacity paper containing white and black pigments that can be used as an outer wrapper for smoking articles.

Another object of the present invention is to provide a wrapping paper for smoking articles having an opacity of greater than 80%.

It is another object of the present invention to provide a wrapping paper for smoking articles that contains black pigments for increasing the opacity but without decreasing the whiteness and brightness of the paper to an unacceptable level.

Still another object of the present invention is to provide a method for producing high opacity cigarette wrapping papers.

It is another object of the present invention to provide cigarette wrapping papers containing a white pigment having a particle size that is roughly equal to one-half the wavelength of visible light in combination with a small amount of a black pigment.

These and other objects of the present invention are achieved by providing a wrapping paper for a smoking article. The wrapping paper includes a paper substrate containing a first filler and a second filler. The first filler comprises a white pigment having a median particle size of from about 0.1 microns to about 0.5 microns, and more particularly from about 0.2 microns to about 0.4 microns.

The second filler comprises a black pigment being present within the paper substrate in an amount up to about 2% by weight and particularly from about 0.1% to about 1.0% by weight. In accordance with the present invention, the wrapping paper has an opacity of at least 80% and a brightness of at least 70%.

In one embodiment, the white pigment is calcium carbonate, while the black pigment is carbon, iron oxide, or mixtures thereof. The white pigment can be present within the paper substrate in an amount of from about 20% to about 40% by weight.

The wrapping paper made in accordance with the present invention can have a basis weight of from about 18 gsm to about 60 gsm, a permeability of from about 5 Coresta units to about 80 Coresta units and can be coated with a burn control additive.

In one preferred embodiment, the wrapping paper has an opacity of at least 90%.

These and other objects of the present invention are also achieved by providing a method for increasing the opacity of a wrapping paper for a smoking article. The method includes the steps of incorporating into a paper substrate a first filler comprising a white pigment. The white pigment has a median particle size of from about 0.1 microns to about 0.5 microns and is added to the substrate in an amount from about 20% to about 40% by weight.

The method also includes the step of incorporating into the paper substrate a second filler comprising a black pigment. The black pigment is added in an amount up to about 2% by weight. When the white pigment and the black pigment are combined together as described above, the opacity of the wrapping paper increases to an amount up to at least about 80%, and, in some applications to at least about 90%.

In one embodiment, the white pigment can be calcium carbonate having a median particle size of from about 0.2 microns to about 0.4 microns and can be present in the paper in an amount from about 25% to about 35% by weight. The wrapping paper can have a basis weight of from about 22 gsm to about 36 gsm and a permeability of from about 15 Coresta units to about 55 Coresta units.

The present invention is also directed to smoking articles containing a column of a smokable filler. The column of a smokable filler is surrounded by a high opacity wrapping paper as described above.

Other objects features and aspects of the present invention are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying figures, in which.

DETAILED DESCRIPTION OF PREFERRED EMBODIMENTS

Figure 1:
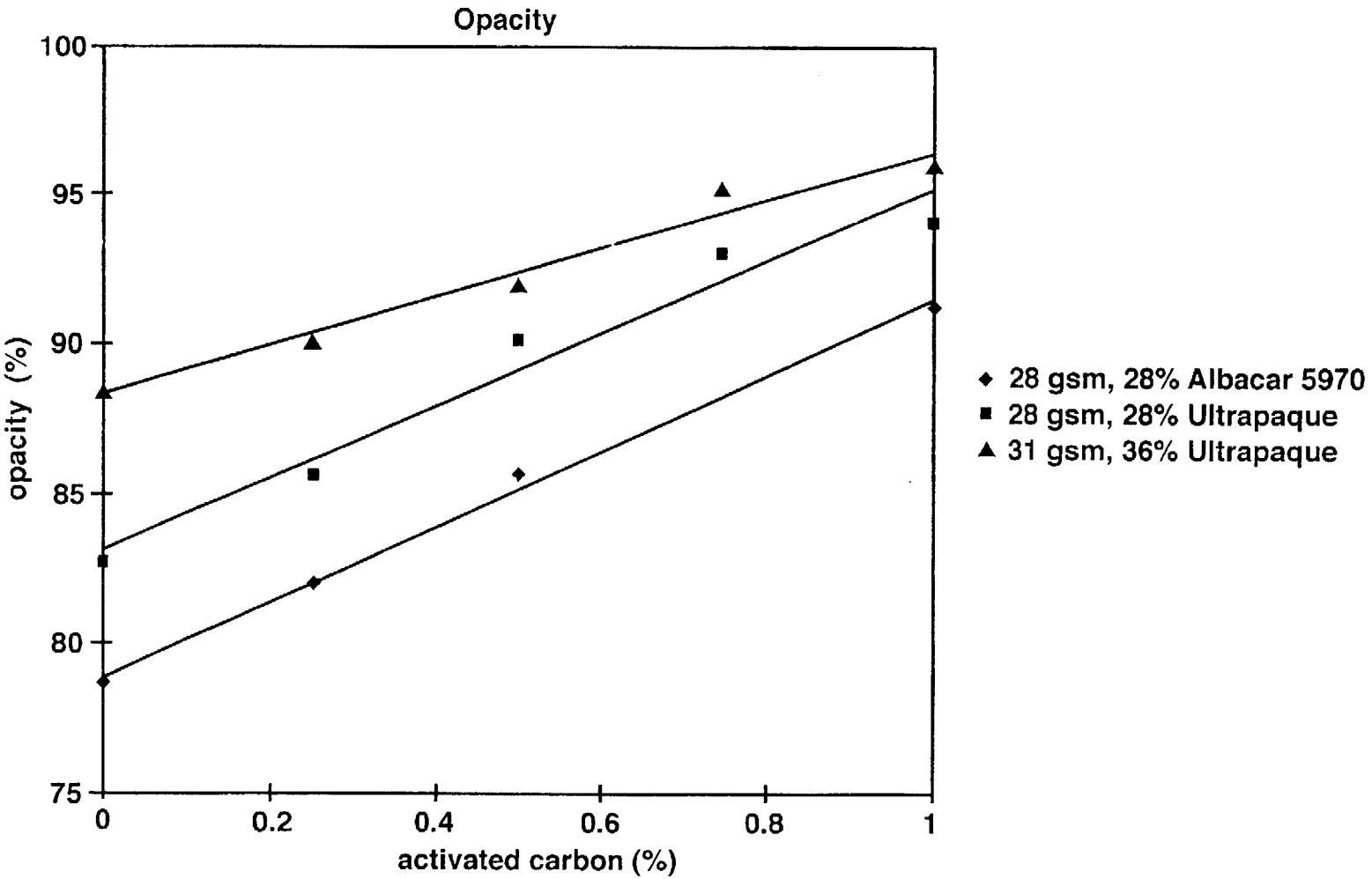
FIG. 1 is a graphical representation of the results obtained in Example 1 below.

It is to be understood by one of ordinary skill in the art that the present discussion is a description of exemplary embodiments only, and is not intended as limiting the broader aspects of the present invention which broader aspects are embodied in the exemplary construction.

The present invention is generally directed to a high opacity wrapping paper for smoking articles. The wrapping paper contains a white pigment in combination with a black pigment. The white pigment is effective in scattering light that contacts the paper. The black pigment, on the other hand, absorbs light. When used in combination, the opacity of the paper is greatly increased beyond conventional levels.

By increasing the opacity of the wrapping paper in accordance with the present invention, the overall aesthetic appearance of a smoking article made with the wrapper is greatly enhanced. The wrapping paper of the present invention can have an opacity, in most instances, greater than at least 80%, which is a significant improvement over conventional cigarette wrapping papers which typically have an opacity of about 74% to about 76%. In fact, wrappers made in accordance with the present invention can even have an opacity greater than 90%. For instance, thus far, wrappers have been made having an opacity from about 82% to about 96%. Such high opacity papers, besides having a distinctive and pleasing appearance, are effective when incorporated into a smoking article in masking the color and appearance of the tobacco contained within the article.

Of particular advantage, wrapping papers made in accordance of the present invention contain small amounts of a black pigment for increasing the opacity of the paper without decreasing the whiteness and brightness of the paper below acceptable levels, as was not possible in the past using conventional papers. According to the present invention, it has been discovered that a black pigment can be incorporated into a wrapping paper for increasing opacity if combined with a white pigment having specially selected optical properties.

In particular, it has been discovered that white pigments having a particle size within a selected range not only increase opacity, but also significantly increase the whiteness and brightness of the paper. Increasing the whiteness and brightness of the paper above conventional levels makes it possible to add black pigments.

Specifically, the white pigment incorporated into the wrapping paper of the present invention should have a median particle size of from about 0.1 microns to about 0.5 microns, and particularly from about 0.2 microns to about 0.4 microns. It is believed that the opacity, whiteness and brightness of a wrapping paper incorporating a white pigment within the above defined size range are increased due in part to the fact that the particle size of the pigment corresponds approximately to one-half the wavelength of visible light. Within this particle size range, it is believed that the white pigment is more effective in scattering light, providing the optical benefits.

In one embodiment, the white pigment incorporated into the wrapping paper of the present invention is calcium carbonate having a particle size of from about 0.1 microns to about 0.5 microns. For instance, in one preferred embodiment, a calcium carbonate pigment marketed under the name ULTRAPAQUE by Speciality Minerals, Inc. of Adams, Mass. is used. ULTRAPAQUE is a precipitated calcium carbonate filler having a mean particle size of about 0.3 microns. The calcium carbonate particles have a rhombohedral shape/morphology and have a surface area of approximately 7.5 $m^2$/gr. ULTRAPAQUE is commercially available as a slurry containing approximately 40% by weight solids or as a dry powder. The slurry or dry powder can be added directly to the cellulosic fibers during the paper making process. As used herein the particle size of a composition is measured and determined by a sedimentation procedure using, for instance, a Sedigraph.

Besides calcium carbonate, it is believed that other white pigments having a particle size within the above defined range can similarly be used to construct wrapping papers made according to the present invention. Also, it is believed that calcium carbonate may be used alone or in combination with other white pigments.

The black pigment used in combination with the white pigment according to the present invention can be, for instance, carbon, such as an activated carbon, a black iron oxide, or mixtures thereof. The particle size of the black pigment is generally less critical. For instance, in most applications, the particle size of the black pigment can be up to approximately 10 microns or less. The black pigment should be added to the paper in combination with the white pigment in an amount so as not to decrease the brightness of the paper below acceptable levels. In general, the brightness of the paper when containing the black pigment should be at least about 70% as measured by the TAPPI method. Preferably, the paper should have a brightness level of from about 70% to about 80%.

Similarly, the black pigment should be added to the paper so as not to decrease the whiteness of the paper below conventional levels. For instance, the wrapping paper of the present invention should have an L value of at least about 80% in most applications. The L value is a measure of paper whiteness on the Hunter color scale and is measured using a spectrophotometer, such as a TCS II spectrophotometer. More particularly, the L value of a wrapping paper made according to the present invention can have an L value of from about 80% to about 90%.

Thus far, when calcium carbonate is used as the white pigment and either carbon or iron oxide is used as the black pigments, the black pigment can be added to the wrapping paper in an amount up to about 2% by weight, and particularly from about 0.1% to about 1.0% by weight based on the total weight of the paper. According to the present invention, a black pigment may be incorporated into a wrapping paper within the above weight range without decreasing the whiteness or brightness of the paper below the above described levels.

Another significant advantage to the present invention is that the opacity of wrapping paper can be substantially increased without increasing the total filler levels within the paper. As is conventional, wrappers made according to the present invention can have a total filler level, which includes the weight of the white and black pigments, of between about 20% to about 40% by weight, and particularly between about 25% to about 36% by weight. The filler can be made completely from the white and black pigments or can include other filler materials if desired.

In one preferred embodiment, calcium carbonate having a particle size of from about 0.1 microns to about 0.5 microns is added to the wrapping paper in an amount from about 20% to about 40% by weight in combination with a black pigment in an amount up to about 2% by weight. Within these ranges, the opacity of a wrapping paper can be increased without effecting the physical properties of the paper, such as the permeability of the paper.

The fiber furnish used to make wrapping papers in accordance with the present invention can include cellulosic fibers obtained, for instance, from flax, soft wood or hard wood. In order to vary the physical properties of the paper, different mixtures of fibers may be used and the amount of refinement of the papers may be varied without affecting the attributes of the present invention.

The permeability of paper wrappers made according to the present invention can be generally from about 5 Coresta units to about 80 Coresta units. In most applications, the permeability should be between about 15 Coresta units to about 55 Coresta units.

The basis weight of the wrapping papers can be from about 18 gsm to about 60 gsm and more particularly between about 22 gsm to about 36 gsm. The wrapping paper may also be treated with a burn control additive. Such burn control additives can include, for instance, alkali metal salts, acetates, phosphate salts or mixtures thereof. A particularly preferred burn control additive is a mixture of potassium citrate and sodium citrate. The burn control additive can be added to the paper in an amount from about 0.3% to about 12% by weight, and more particularly between about 0.3% to about 3% by weight.

The white and black pigments of the present invention may be incorporated into the paper wrapper according to various known methods. For instance, in one embodiment, the pigments can be combined in a slurry and added to a suspension of cellulosic fibers when forming the paper.

The present invention may be better understood with reference to the following examples.

EXAMPLE NO. 1

In order to demonstrate the present invention, various hand sheets were made incorporating into the paper a white pigment and a black pigment. In one set of hand sheets, the white pigment incorporated into the paper was ALBACAR 5970 calcium carbonate filler, a conventionally used filler having a median particle size of about 1.9 microns. The ALBACAR 5970 filler, which was obtained from Specialty Minerals, Inc. of Adams, Mass., was incorporated into the paper in an amount of 28% by weight. The paper in this first set had a basis weight of 28 gsm.

In a second set of hand sheets instead of ALBACAR 5970 filler, ULTRAPAQUE calcium carbonate particles, having a mean particle size of about 0.3 microns, were added to the paper in accordance with the present invention. The ULTRAPAQUE filler was added to the paper in an amount of 28% by weight. The basis weight of the paper was 28 gsm.

A third set of hand sheets were produced also containing ULTRAPAQUE particles in accordance with the present invention. In this third set, however, the ULTRAPAQUE was added in an amount of 31% by weight. The hand sheets had a basis weight of 31 gsm.

To each of the three sets of hand sheets described above, activated carbon was added in increasing amounts up to 1% by weight. The activated carbon was obtained from Calgon Corporation of Pittsburgh, Pa. and is marketed under the tradename KCG. The opacity of the hand sheets were then measured using an opacity meter. The results are illustrated in FIG. 1.

FIG. 1 shows how opacity increases as the level of activated carbon increases. As shown, the hand sheets containing the white pigment having a median size of 0.3 microns in accordance with the present invention had a much higher starting and ending opacity than the hand sheets made with ALBACAR 5970 filler. In fact, the handsheets containing the ULTRAPAQUE pigment had an opacity of greater than 90% when carbon was added in an amount of 1% by weight.

EXAMPLE NO. 2

The same hand sheets made in Example No. 1 were also tested for L value, which is a measure of paper whiteness on the Hunter color scale. The results of the test are illustrated in FIG. 2.

Figure 2:
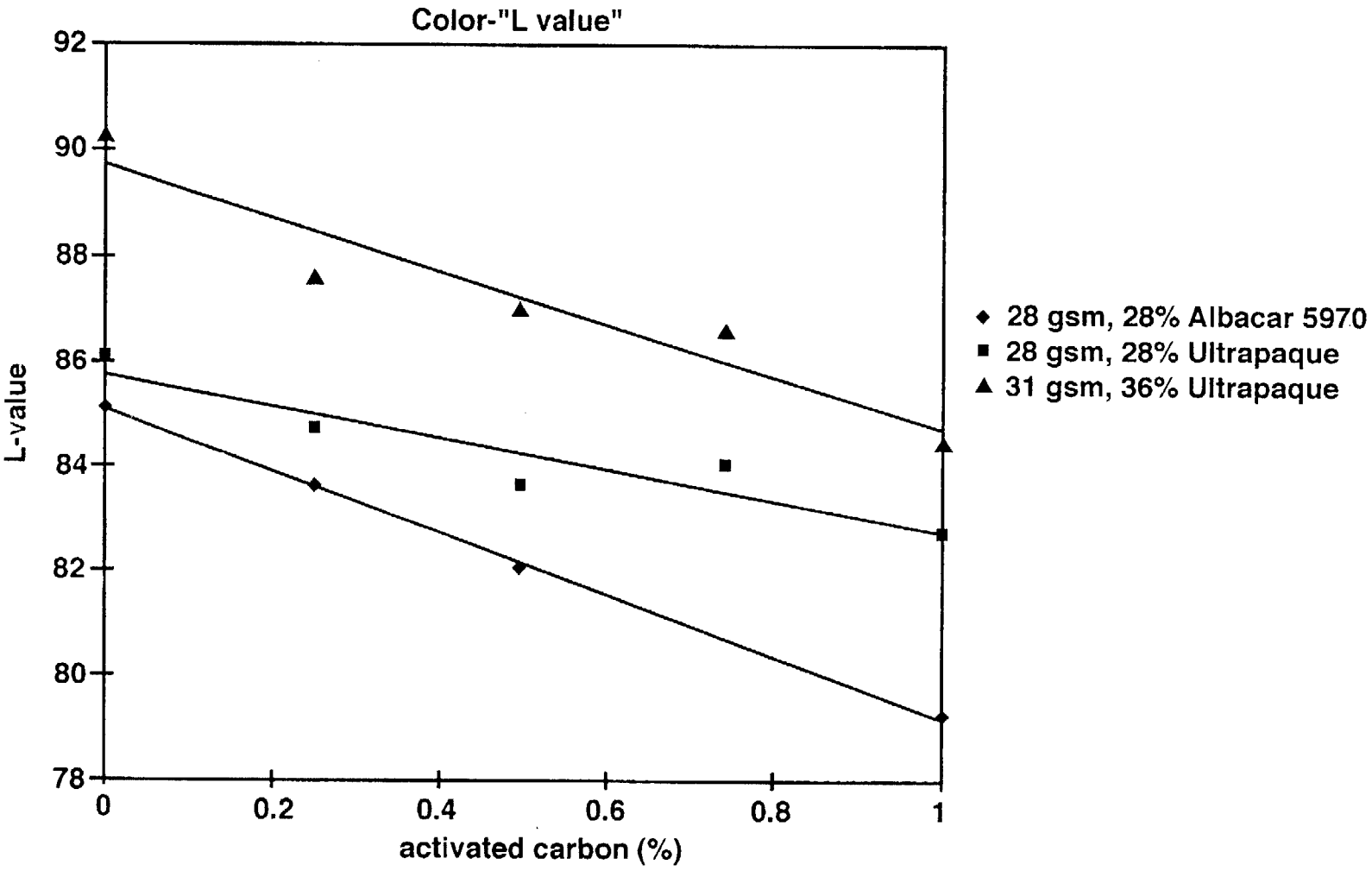
FIG. 2 is a graphical representation of the results obtained in Example 2 below.

FIG. 2 illustrates how the L value or whiteness of the paper decreases as increasing amounts of a black pigment are added to the paper.

As also shown, however the hand sheets made with ULTRAPAQUE filler had a much higher starting whiteness than the hand sheets made with ALBACAR 5970. In fact, the hand sheets containing the ULTRAPAQUE white pigment and 1% by weight carbon had a whiteness value comparable with the initial whiteness value of the carbonless hand sheets containing ALBACAR 5970 pigment.

EXAMPLE NO. 3

The hand sheets described in Example No. 1 were also tested for brightness using a brightness meter. The results obtained are illustrated in FIG. 3.

Figure 3:
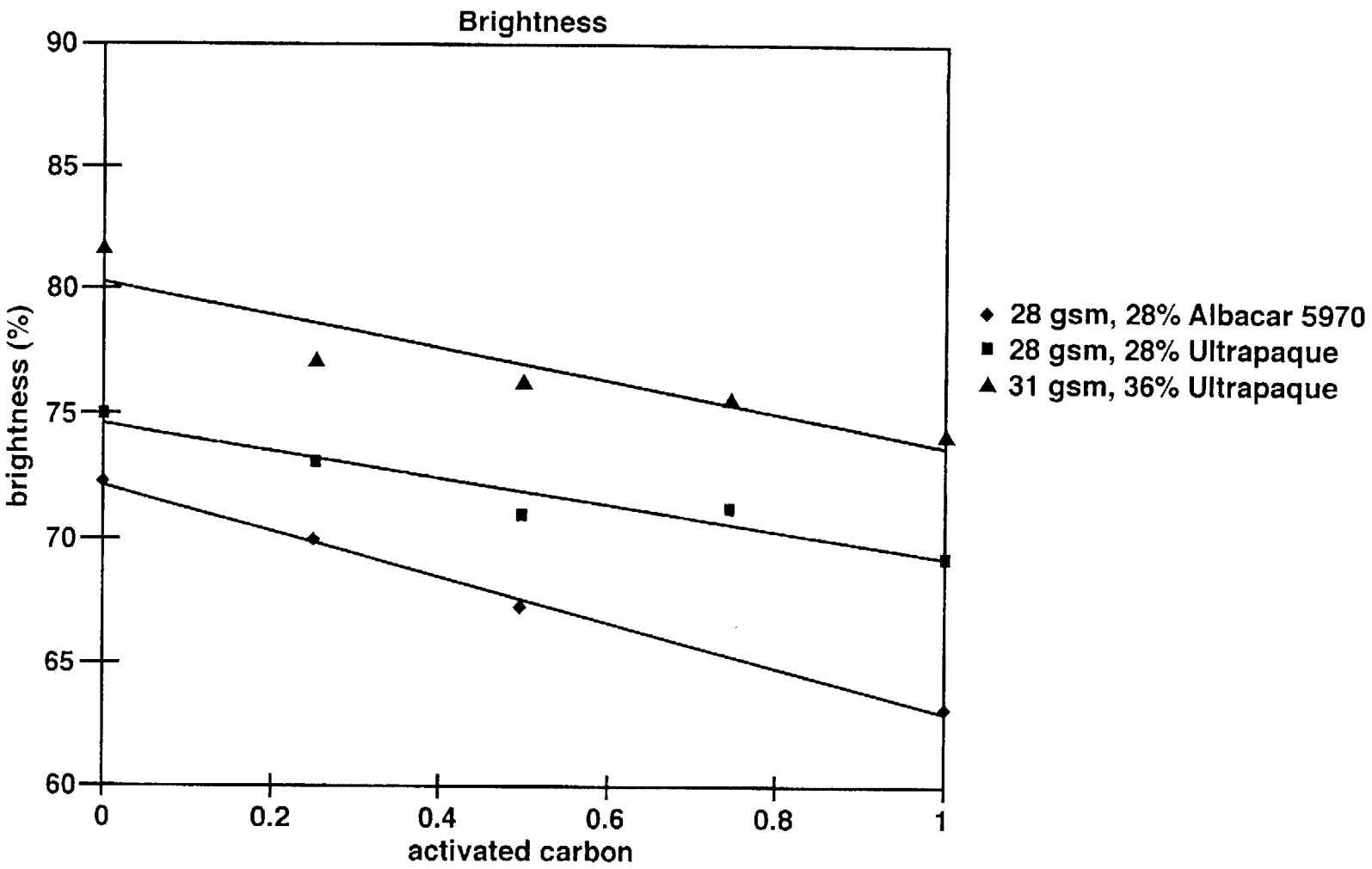
FIG. 3 is a graphical representation of the results obtained in Example 3 below.

As shown in FIG. 3, the initial brightness of the hand sheets made according to the present invention containing ULTRAPAQUE filler was much higher than the brightness of the carbonless hand sheets made using ALBACAR 5970.

As carbon was added to the hand sheets, the brightness of the paper decreased. However, since the initial brightness of the ULTRAPAQUE containing sheets were higher than the initial brightness of the hand sheets containing ALBACAR 5970, the carbon could be added to the ULTRAPAQUE sheets without causing the brightness of the sheets to decrease significantly below the initial brightness of the ALBACAR 5970 sheets containing no carbon.

These and other modifications and variations to the present invention may be practiced by those of ordinary skill in the art, without departing from the spirit and scope of the present invention, which is more particularly set forth in the appended claims. In addition it should be understood that aspects of the various embodiments may be interchanged both in whole or in part. Furthermore those of ordinary skill in the art will appreciate that the foregoing description is by way of example only, and is not intended to limit the invention so further described in such appended claims.

What is claimed is:

1. A wrapping paper for a smoking article comprising:

a paper substrate containing a first filler and a second filler, said first filler comprising a white pigment having a median particle size of from about 0.1 microns to about 0.5 microns, said second filler comprising a black pigment being present within said paper substrate in an amount up to about 2% by weight, said wrapping paper having an opacity of at least 80% and a brightness of at least 70%.

2. A wrapping paper as defined in claim 1, wherein said white pigment comprises calcium carbonate.

3. A wrapping paper as defined in claim 1, wherein said black pigment comprises a material selected from the group consisting of carbon, iron oxide, and mixtures thereof.

4. A wrapping paper as defined in claim 1, wherein said white pigment is present within said paper substrate in an amount from about 20% to about 40% by weight.

5. A wrapping paper as defined in claim 1, wherein said white pigment has a median particle size of from about 0.2 microns to about 0.4 microns.

6. A wrapping paper as defined in claim 1, wherein said paper substrate has a basis weight of from about 18 gsm to about 60 gsm and has a permeability of from about 5 Coresta units to about 80 Coresta units.

7. A wrapping paper as defined in claim 6, further comprising a burn control additive coated onto said paper substrate, said burn control additive being a material selected from the group consisting of alkali metal salts, acetates, phosphate salts, and mixtures thereof.

8. A wrapping paper as defined in claim 1, wherein said wrapping paper has an opacity of at least 90%.

9. A wrapping paper as defined in claim 1, wherein said black pigment is present within said paper substrate in an amount from about 0.1% to about 1.0% by weight.

10. A wrapping paper for a smoking article comprising:

a paper substrate containing a first filler and a second filler, said first filler comprising calcium carbonate having a median particle size of from about 0.1 microns to about 0.5 microns, said calcium carbonate being present within said paper substrate in an amount from about 20% to about 40% by weight, said second filler comprising a black pigment being present within said paper substrate in an amount up to about 2% by weight.

11. A wrapping paper as defined in claim 10, wherein said wrapping paper has an opacity of at least 80% and a brightness of at least 70%.

12. A wrapping paper as defined in claim 11, wherein said wrapping paper has an opacity of at least 90%.

13. A wrapping paper as defined in claim 11, wherein said wrapping paper has an L value of at least about 80%.

14. A wrapping paper as defined in claim 1, wherein said black pigment comprises a material selected from the group consisting of carbon, iron oxide, and mixtures thereof, said black pigment being present within said paper substrate in an amount from about 0.1% to about 1.0% by weight.

15. A wrapping paper as defined in claim 14, wherein said calcium carbonate has a median particle size of from about 0.2 microns to about 0.4 microns.

16. A wrapping paper as defined in claim 10, wherein said paper substrate has a basis weight of from about 22 gsm to about 36 gsm, has a permeability of from about 15 Coresta units to about 55 Coresta units, and has a total filler content of from about 25% to about to about 36% by weight.

17. A method for increasing the opacity of a wrapping paper for a smoking article comprising the steps of:

incorporating into a paper substrate a first filler comprising a white pigment, said white pigment having a median particle size of from about 0.1 microns to about 0.5 microns, said white pigment being added to said paper substrate in an amount from about 20% to about 40% by weight;

incorporating into said paper substrate a second filler comprising a black pigment, said black pigment being added to said paper substrate in an amount up to about 2% by weight; and wherein said white pigment and said black pigment are added to said wrapping paper in an amount sufficient to increase the opacity of said wrapping paper up to at least about 80%.

18. A method as defined in claim 17, wherein said wrapping paper has a brightness of at least about 70% and an L value of at least about 80%.

19. A method as defined in claim 17, wherein said white pigment comprises calcium carbonate.

20. A method as defined in claim 19, wherein said white pigment is present within said paper substrate in an amount from about 25% to about 35% by weight and has a median particle size of from about 0.2 microns to about 0.4 microns.

21. A method as defined in claim 20, wherein said black pigment comprises a material selected from the group consisting of carbon, iron oxide, and mixtures thereof.

22. A method as defined in claim 21, wherein said wrapping paper has a basis weight of from about 22 gsm to about 36 gsm and a permeability of from about 15 Coresta units to about 55 Coresta units.

23. A method as defined in claim 22, wherein said wrapping paper has an opacity of at least about 90%.

24. A smoking article comprising:

a column of a smokable filler; and a wrapping paper surrounding said column of said smokable filler, said wrapping paper comprising a paper substrate containing calcium carbonate having a median particle size of from about 0.2 microns to about 0.4 microns, said paper substrate also containing a black pigment, said wrapping paper having a basis weight of from about 22 gsm to about 36 gsm, a permeability of from about 15 Coresta units to about 55 Coresta units, a total filler content of from about 25% to about 36% by weight, and an opacity of at least about 80%.

25. A smoking article as defined in claim 24, wherein said black pigment comprises carbon, said carbon being present within said paper substrate in an amount up to about 2% by weight.

26. A smoking article as defined in claim 24, wherein said wrapping paper has a brightness of at least about 70% and an L value of at least about 80%.

27. A smoking article as defined in claim 24, wherein said wrapping paper has an opacity of at least about 90%.

* * * * *